US011295679B2

(12) United States Patent
Lee

(10) Patent No.: US 11,295,679 B2
(45) Date of Patent: Apr. 5, 2022

(54) METHOD AND APPARATUS FOR COMPENSATING VIEW CHROMATIC ABERRATION OF DISPLAY DEVICE AND DISPLAY DEVICE

(71) Applicants: HKC CORPORATION LIMITED, Shuitian Village (CN); CHONGQING HKC OPTOELECTRONICS TECHNOLOGY CO.,LTD., Chongqing (CN)

(72) Inventor: Chia-Hang Lee, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 398 days.

(21) Appl. No.: 16/466,503

(22) PCT Filed: Sep. 1, 2017

(86) PCT No.: PCT/CN2017/100251
§ 371 (c)(1),
(2) Date: Jun. 4, 2019

(87) PCT Pub. No.: WO2018/090693
PCT Pub. Date: May 24, 2018

(65) Prior Publication Data

US 2021/0319760 A1 Oct. 14, 2021

(30) Foreign Application Priority Data

Nov. 17, 2016 (CN) ..... 201611034305.X

(51) Int. Cl.
*G09G 5/10* (2006.01)
*G09G 3/34* (2006.01)
*G09G 3/36* (2006.01)

(52) U.S. Cl.
CPC ..... *G09G 3/3413* (2013.01); *G09G 3/3611* (2013.01); *G09G 2300/0452* (2013.01); (Continued)

(58) Field of Classification Search
CPC ..... G09G 3/3413; G09G 3/3611; G09G 2300/0452; G09G 2320/0233; (Continued)

(56) References Cited

U.S. PATENT DOCUMENTS

2007/0290964 A1* 12/2007 Yang ..... G09G 3/3648 345/87
2008/0094426 A1* 4/2008 Kimpe ..... G09G 3/20 345/691
2009/0289961 A1* 11/2009 Kim ..... G09G 3/3406 345/690

* cited by examiner

*Primary Examiner* — Jennifer T Nguyen
(74) *Attorney, Agent, or Firm* — Wang Law Firm, Inc.

(57) ABSTRACT

A method and apparatus for compensating view chromatic aberration of a display device, and a display device are provided, which includes: receiving an inputted image, obtaining a first pixel voltage and a second pixel voltage of each of pixels in two adjacent frames of the image, looking-up the first pixel voltage and the second pixel voltage and obtaining a corresponded first driving signal and a corresponded second driving signal, individually, computing a brightness compensation signal required in a backlight module of a backlight region based on the first driving signal, the second driving signal and a predetermined standard brightness signal, and compensating view chromatic aberration of a post frame of the image based on the brightness compensation signal.

15 Claims, 7 Drawing Sheets

(52) U.S. Cl.
CPC ..... *G09G 2320/0233* (2013.01); *G09G 2320/0242* (2013.01); *G09G 2320/0646* (2013.01); *G09G 2360/16* (2013.01)

(58) Field of Classification Search
CPC ... G09G 2320/0242; G09G 2320/0646; G09G 2360/16
USPC ..... 345/690
See application file for complete search history.

METHOD AND APPARATUS FOR COMPENSATING VIEW CHROMATIC ABERRATION OF DISPLAY DEVICE AND DISPLAY DEVICE

CROSS-REFERENCE TO RELATED APPLICATION

This application is a National Stage Application of PCT International Patent Application No. PCT/CN2017/100251 filed on Sep. 1, 2017, under 35 U.S.C. § 371, which claims priority to Chinese Patent Application No. 201611034305.X filed on Nov. 17, 2016, which are all hereby incorporated by reference in their entirety.

BACKGROUND OF THE INVENTION

1. Field of the Invention

The present application relates to the panel display technology, in particular, to a method and apparatus for compensating view chromatic aberration of a display device, and a display device.

2. Description of the Related Art

Recently, most of large-size liquid crystal display panels utilize negative type VA liquid crystal or IPS liquid crystal technologies. The VA type liquid crystal technology has advantages of high production efficiency and low manufacturing cost in comparison with the IPS liquid crystal technology, but has obvious defects of optical properties in comparison with the IPS liquid crystal technology. Especially, a large-size liquid crystal display panel requires a larger viewing angle of presenting in commercial applications. The VA type liquid crystal driver is often unable to meet the demand of the commercial applications in terms of view chromatic aberration, which affects the promotion of the VA type liquid crystal technology.

A general method that a VA type liquid crystal technology overcomes view chromatic aberration is to further divide each of the primary colors RGB (red, green and blue) into a main pixel and a sub pixel, and solve the defect of view chromatic aberration via that the main and sub pixels provide different driving voltages in spatial. This kind of design often requires further designing metal wirings or thin film transistor elements for driving the sub pixel, which may sacrifice light transmittable opening regions, affects the transmittance of the panel, and directly results in the increased cost of a backlight module.

SUMMARY OF THE INVENTION

The present application provides a method of compensating view chromatic aberration of a display device executed via a computer device, which is able to reduce view chromatic aberration, gain the transmittance of the panel and reduce the cost of the backlight module.

In order to achieve the above objects, the method of compensating view chromatic aberration of a display device provided by the present application comprises steps as follows:

controlling the display device to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually;

computing a brightness compensation signal required in a backlight module of a backlight region based on the first driving signal, the second driving signal and a predetermined standard brightness signal; and compensating view chromatic aberration of a post frame of the image based on the brightness compensation signal.

In an embodiment, after the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually", and before the step of "computing a brightness compensation signal required in a backlight module of a backlight region based on the first driving signal, the second driving signal and a predetermined standard brightness signal", the method further comprises a step as follow:

determining if the backlight brightness needs to be compensated or not based on the first driving signal and the second driving signal.

In an embodiment, when a backlight source of white color is utilized in the backlight module, the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually" comprises:

receiving the two adjacent frames of the image; obtaining the first pixel voltage and the second pixel voltage of a first primary color of each of the pixels; and looking-up the first pixel voltage and the second pixel voltage; obtaining the first driving signal and the second driving signal corresponded to the first pixel voltage; and obtaining the first driving signal and the second driving signal corresponded to the second pixel voltage.

In an embodiment, the first primary color is green primary color.

In an embodiment, the step of "computing a brightness compensation signal required in a backlight module of a backlight region based on the first driving signal, the second driving signal and a predetermined standard brightness signal" comprises:

substituting related parameters into following formulas and computing the required brightness compensation signals:

$$An_L*G_{TH}+An_L*G_{TL}=An_L_L G*_{TH}+An_L_H*G_{TL};$$

$$An_L*G'_{TH}+An_L*G'_{TL}=An_L_L*G'_{TH}+An_L_H*G'_{TL};$$

wherein An_L is the standard brightness signal; $G_{TH}$, $G_{TL}$ are the first driving signal and the second driving signal corresponded to the first pixel voltage respectively; $G'_{TH}$, $G'_{TL}$ are the first driving signal and the second driving signal corresponded to the second pixel voltage; and $An_L_L$ and $An_L_H$ are the brightness compensation signals required for computation.

In an embodiment, the step of "determining if the backlight brightness needs to be compensated or not based on the first driving signal and the second driving signal" comprises:

obtaining a difference between the first driving signal and the second driving signal corresponded to the first pixel voltage; if the value of the difference is in a predetermined range, then the backlight brightness will not be compensated; if the value of the difference is beyond the predetermined range, then the backlight brightness will be compensated.

In an embodiment, when a backlight source of three primary colors is utilized in the backlight module, the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually" comprises:

receiving the two adjacent frames of the image; obtaining the first pixel voltage and the second pixel voltage of a first primary color, a second primary color and a third primary color of each of the pixels; and looking-up the first pixel voltage and the second pixel voltage; obtaining the first driving signal and the second driving signal corresponded to the first pixel voltage of the first primary color, the second primary color and the third primary color, individually; and obtaining the first driving signal and the second driving signal corresponded to the second pixel voltage of the first primary color, the second primary color and the third primary color, individually.

In an embodiment, the step of "computing a brightness compensation signal required in a backlight module of a backlight region based on the first driving signal, the second driving signal and a predetermined standard brightness signal" comprises:

substituting related parameters into following formulas and computing the required brightness compensation signals:

$$An_L_R*R_{TH}+An_L_R*R_{TL}=An_L_{RL}*R_{TH}+An_L_{RH}*R_{TL};$$

$$An_L_G*G_{TH}+An_L_G*G_{TL}=An_L_{GL}*G_{TH}+An_L_{GH}*G_{TL};$$

$$An_L_B*B_{TH}+An_L_B*B_{TL}=An_L_{BL}*B_{TH}+An_L_{BH}*B_{TL};$$

$$An_L_R*R'_{TH}+An_L_R*R'_{TL}=An_L_{RL}*R'_{TH}+An_L_{RH}*R'_{TL};$$

$$An_L_G*G'_{TH}+An_L_G*G'_{TL}=An_L_{GL}*G'_{TH}+An_L_{GH}*G'_{TL};$$

$$An_L_B*B'_{TH}+An_L_B*B'_{TL}=An_L_{BL}*B'_{TH}+An_L_{BH}*B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded of the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

The present application further provides a view chromatic aberration compensation apparatus of a display device, comprising:

a signal obtaining module for receiving an inputted image; obtaining a first pixel voltage and a second pixel voltage of each of pixels in two adjacent frames of the image; and looking-up the first pixel voltage and the second pixel voltage and obtaining a corresponded first driving signal and a corresponded second driving signal, individually;

a computation module for computing a brightness compensation signal required in two frames of a backlight module of a backlight region corresponded to voltages of different levels, based on the first driving signal, the second driving signal and a predetermined standard brightness signal; and a backlight compensation module for compensating view chromatic aberration of a post frame of the image based on the brightness compensation signal.

In an embodiment, the view chromatic aberration compensation apparatus of the display device further comprises:

a determination module for determining if the backlight brightness needs to be compensated or not based on the first driving signal and the second driving signal.

In an embodiment, when a backlight source of white color is utilized in the backlight module, the signal obtaining module receives the two adjacent frames of the image; obtains the first pixel voltage and the second pixel voltage; looks-up the first pixel voltage and the second pixel voltage; obtains the first driving signal and the second driving signal corresponded to the first pixel voltage; and obtains the first driving signal and the second driving signal corresponded to the second pixel voltage.

In an embodiment, the first primary color is green primary color.

In an embodiment, the computation module substitutes related parameters into following formulas and computes the required brightness compensation signals:

$$An_L*G_{TH}+An_L*G_{TL}=An_L*G_{TH}+An_L*G_{TL};$$

$$An_L*G'_{TH}+An_L*G'_{TL}=An_L*G'_{TH}+An_L*G'_{TL};$$

wherein An_L is the standard brightness signal; $G_{TH}$, $G_{TL}$ are the first driving signal and the second driving signal corresponded to the first pixel voltage respectively; $G'_{TH}$, $G'_{TL}$ are the first driving signal and the second driving signal corresponded to the second pixel voltage; and $An_L_L$ and $An_L_H$ are the brightness compensation signals required for computation.

In an embodiment, the determination module obtains a difference between the first driving signal and the second driving signal corresponded to the first pixel voltage; if the value of the difference is in a predetermined range, then the backlight brightness will not be compensated; if the value of the difference is beyond the predetermined range, then the backlight brightness will be compensated.

In an embodiment, when a backlight source of three primary colors is utilized in the backlight module, the signal obtaining module receives the two adjacent frames of the image; obtains the first pixel voltage and the second pixel voltage of a first primary color, a second primary color and a third primary color of each of the pixels; and looks-up the first pixel voltage and the second pixel voltage; obtains the first driving signal and the second driving signal corresponded to the first pixel voltage of the first primary color, the second primary color and the third primary color, individually; and obtains the first driving signal and the second driving signal corresponded to the second pixel voltage of the first primary color, the second primary color and the third primary color, individually.

In an embodiment, the computation module substitutes related parameters into following formulas and computes the required brightness compensation signals:

$$An_L_R*R_{TH}+An_L_R*R_{TL}=An_L_{RL}*R_{TH}+An_L_{RH}*R_{TL};$$

$$An_L_G*G_{TH}+An_L_G*G_{TL}=An_L_{GL}*G_{TH}+An_L_{GH}*G_{TL};$$

$$An_L_B*B_{TH}+An_L_B*B_{TL}=An_L_{BL}*B_{TH}+An_L_{BH}*B_{TL};$$

$$An_L_R*R'_{TH}+An_L_R*R'_{TL}=An_L_{RL}*R'_{TH}+An_L_{RH}*R'_{TL};$$

$$An_L_G*G'_{TH}+An_L_G*G'_{TL}=An_L_{GL}*G'_{TH}+An_L_{GH}*G'_{TL};$$

$$An_L_B*B'_{TH}+An_L_B*B'_{TL}=An_L_{BL}*B'_{TH}+An_L_{BH}*B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded to the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

The present application further provides a display device, comprising:

a display device;

a driving component; and a view chromatic aberration compensation apparatus as described above.

Preferably, the view chromatic aberration compensation apparatus further comprises a determination module for determining if the backlight brightness needs to be compensated or not based on the first driving signal and the second driving signal.

Preferably, when a backlight source of white color is utilized in the backlight module, the signal obtaining module receives the two adjacent frames of the image; obtains the first pixel voltage and the second pixel voltage; looks-up the first pixel voltage and the second pixel voltage; obtains the first driving signal and the second driving signal corresponded to the first pixel voltage; and obtains the first driving signal and the second driving signal corresponded to the second pixel voltage.

Preferably, the first primary color is green primary color.

The present application receives an inputted image; obtains a first pixel voltage and a second pixel voltage of each of pixels in two adjacent frames of the image; looks-up the first pixel voltage and the second pixel voltage and obtains a corresponded first driving signal and a corresponded second driving signal, individually; computes a brightness compensation signal based on the first driving signal, the second driving signal and a predetermined standard brightness signal; and inputs the brightness compensation signal to a region corresponded to the backlight module, so as to achieve the compensation of view chromatic aberration. The present application does not need to dispose main and sub pixels on the panel, so that the metal wirings and the thin film transistor elements are not need to be designed for driving the sub pixel, which simplifies the manufacture process and reduces the cost thereof Since the sub pixels are deleted, the transmittance of the panel is increased.

BRIEF DESCRIPTION OF THE DRAWINGS

The accompanying drawings required for describing embodiments or prior arts will be briefly described herein, for explaining the technical solutions of the embodiments of the present application or prior art more clearly. Apparently, the accompanying drawings in the following description are merely some embodiments of the present application. A person having ordinary skill in the art is able to obtain other drawings according to these appending drawings without under the premise of paying creative labor. In the accompanying drawings.

The implementation, features and advantages of the objectives of the present application will be further described, taken in conjunction with embodiments and the accompanying drawings

DESCRIPTION OF THE PREFERRED EMBODIMENTS

Hereinafter, the present application will be described clearly and completely taken in conjunction with the accompanying drawings. Apparently, the described embodiments are merely a part, but not all, of the embodiments of the present application. Based on the embodiments of the present application, other embodiments obtained by a person skilled in the art without paying creative labor are in the scopes of the claims of the present application.

It has to be explained that the terms of "the first", "the second" and the likes are merely used for description, but not to be understand as an indicating or implying the relative importance therebetween, or as implying the number of the technical feature being indicated. Hence, the features limited to "the first" and "the second" may indicate or imply that it comprises at least one of the features. Furthermore, the technical solutions between various embodiments may be combined with each other, but must be based on the fact that one of ordinary skill in the art can achieve the combination. When a combination of technical solutions is contradictory or impossible to be achieved, it should be considered as does not exist and is not protected by the scopes of the claim of the present application.

The present application provides a method of compensating view chromatic aberration of a display device.

Figure 1:
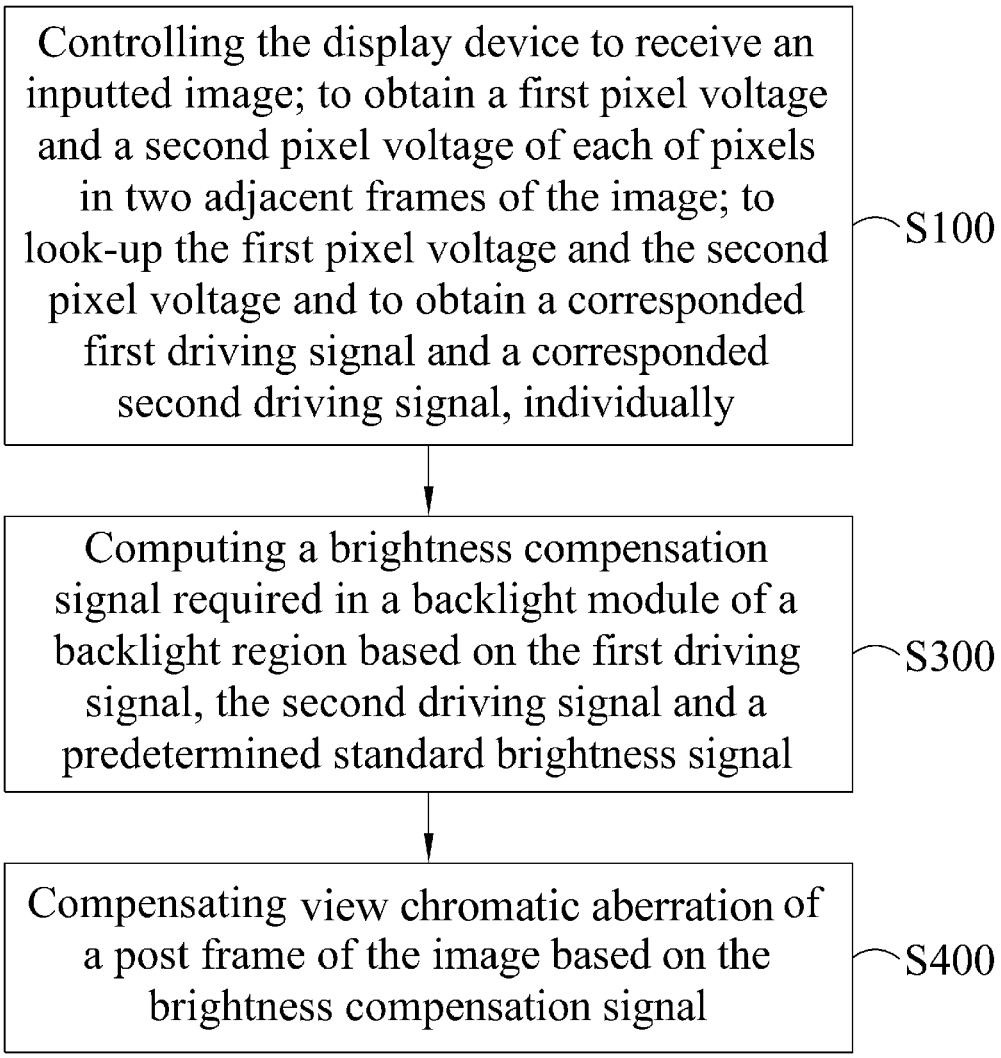
FIG. 1 is a flowing chart of an embodiment of the method of compensating view chromatic aberration of a display device of the present application.

Referring to FIG. 1, in an embodiment of the present application, the method of compensating view chromatic aberration of a display device comprises the steps as follows:

S100, receiving an inputted image; obtain a first pixel voltage and a second pixel voltage of each of pixels in two adjacent frames of the image; look-up the first pixel voltage and the second pixel voltage and obtain a corresponded first driving signal and a corresponded second driving signal, individually;

S300, computing a brightness compensation signal required in a backlight module of a backlight region based on the first driving signal, the second driving signal and a predetermined standard brightness signal;

S400, compensating view chromatic aberration of a post frame of the image based on the brightness compensation signal.

In the present embodiment, the first driving signal is a high level panel driving signal, and the second driving signal is a low level panel driving signal.

It has to be explained that an image signal comprises the voltage signals of a frame, that is, the first pixel voltage and the second pixel voltage of the frame. In the present embodiment, the first pixel voltage is a high voltage, and the second pixel voltage is a low voltage. A liquid crystal panel driving signal is generally driven by the high voltage signal and the low voltage signal by turns corresponding to the frames of the image. The first driving signals $R_H/H_G/B_H$ and the second driving signals $R_L/G_L/B_L$ are preset high voltage signals and low voltage signals given based on RGB inputted signals beforehand, which are determined based on the effect of the viewing angle required for compensation. The related data is already burned into the display device during manufacture. Generally, it is recorded as a LUT (Look Up Table) in a hardware buffer. With the 8 bit driving signal, each of R/G/B input signals inputs 0~255 are corresponded to 256 high and low voltage signals. A total of 3*256 pairs of high voltage signals $R_H/H_G/B_H$ and low voltage signals $R_L/G_L/B_L$ are existed.

In a display device, the display performance is decided by commonly driving of the panel driving signal and the brightness signal of the backlight source.

In the present embodiment, computing a brightness compensation signal required in a backlight module of a backlight region based on the computed mean values and a predetermined standard brightness signal results in that the display device represents a display performance identical to that driven by the brightness compensation signal, the first driving signal and the second driving signal jointly, under a premise of the cooperation between the standard brightness signal, the first driving signal and the second driving signal.

The present application receives an inputted image; obtains a first pixel voltage and a second pixel voltage of each of pixels in two adjacent frames of the image; looks-up the first pixel voltage and the second pixel voltage and obtains a corresponded first driving signal and a corresponded second driving signal, individually; computes a brightness compensation signal based on the first driving signal, the second driving signal and a predetermined standard brightness signal; and inputs the brightness compensation signal to a region corresponded to the backlight module, so as to achieve the compensation of view chromatic aberration. The present application does not need to dispose main and sub pixels on the panel, so that the metal wirings and the thin film transistor elements are not need to be designed for driving the sub pixel, which simplifies the manufacture process and reduces the cost thereof. Since the sub pixels are deleted, the transmittance of the panel is increased.

Figure 2:
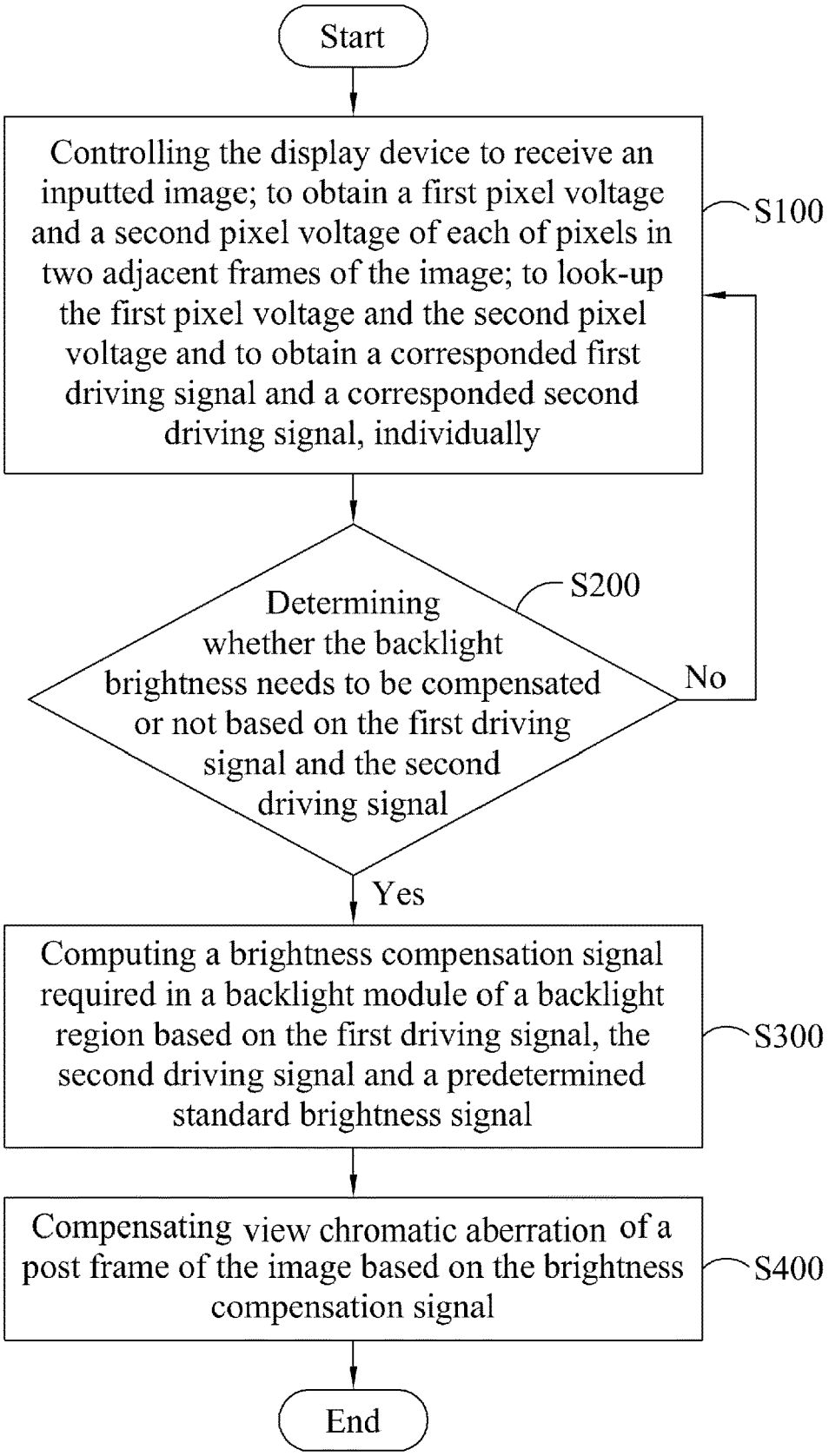
FIG. 2 is a flowing chart of a particular embodiment of the method of compensating view chromatic aberration of a display device of the present application.

Referring to FIG. 2, further, after the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually", and before the step of "computing a brightness compensation signal required in a backlight module of a backlight region based on the first driving signal, the second driving signal and a predetermined standard brightness signal", the method further comprises a step as follow:

S200, determining if the backlight brightness needs to be compensated or not based on the first driving signal and the second driving signal.

When compensating the backlight brightness, human eyes may aware the driving of backlight signals easily because of the frequent adjustments of the backlight brightness. In order to reduce the defect of the backlight adjustment, the backlight brightness is determined if it requires compensation or not, and is only compensated when required, so as to reduce the phenomenon of discomfort of the human eyes.

The present application comprises the embodiments as follows, corresponding to the types of backlight source utilized in the backlight module.

Figure 3:
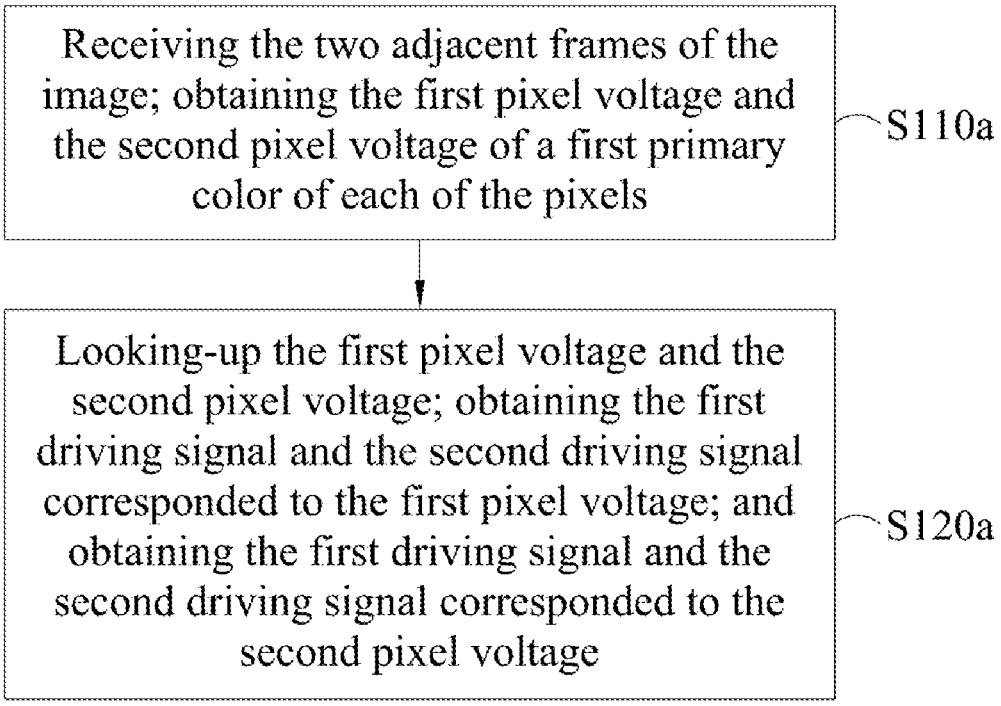
FIG. 3 is a particular flowing chart of an embodiment of the step S100 in FIG. 2.

In an embodiment, referring to FIG. 3, when a backlight source of white color is utilized in the backlight module, the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually" comprises:

S110*a*, receive the two adjacent frames of the image; obtain the first pixel voltage and the second pixel voltage of a first primary color of each of the pixels;

S120*a*, look-up the first pixel voltage and the second pixel voltage; obtain the first driving signal and the second driving signal corresponded to the first pixel voltage; and obtain the first driving signal and the second driving signal corresponded to the second pixel voltage.

It has to be explained that the first pixel voltage and the second pixel voltage (distinguished based on the signal amplitude) are existed in the region of the backlight module, corresponding to the different inputted frames of the image. After the first pixel voltage and the second pixel voltage are obtained, the first driving signal corresponded to first pixel voltage and the second driving signal corresponded to the second pixel voltage are obtained by looking-up.

In the present embodiment, the first primary color is green primary color. Since the white light source only needs to be controlled by a type of brightness signal; the brightness of green primary color is more obvious than that of R/B (red primary color/blue primary color); and the human eyes are more sensitive to the blinking level of those. Thus, the green color is utilized to compute the brightness compensation signal corresponding to the first pixel voltage and the second pixel voltage of the color panel driving signal.

In particular, the step of "computing a brightness compensation signal required in a backlight module of a backlight region based on the first driving signal, the second driving signal and a predetermined standard brightness signal" comprises:

substituting related parameters into following formulas and computing the required brightness compensation signals:

$$An_L*G_{TH}+An_L*G_{TL}=An_L_L G*_{TH}+An_L_H*G_{TL};$$

$$An_L*G'_{TH}+An_L*G'_{TL}=An_L_L*G'_{TH}+An_L_H*G'_{TL};$$

wherein An_L is the standard brightness signal; $G_{TH}$, $G_{TL}$ are the first driving signal and the second driving signal corresponded to the first pixel voltage; $G'_{TH}$, $G'_{TL}$ are the first driving signal and the second driving signal corresponded to the second pixel voltage; and $An_L_L$ and $An_L_H$ are the brightness compensation signals required for computation.

It has to be explained that the two adjacent frames of the image corresponding to the orders of obtained timing are utilized in the present embodiment. The first frame of the image is corresponded to the first driving signals $R_{TH}/G_{TH}/B_{TH}$, and the second frame of the image is corresponded to the second driving signals $R_{TL}/G_{TL}/B_{TL}$. The first frame of the image is corresponded to the brightness signals A1_$L_L$, A2_$L_L$, A3_$L_L$, . . . , $An_L_L$ of the backlight region, wherein n=1, 2, 3 . . . , N, and n is the individually controllable light source region defined in the direct-type backlight. The second frame of the image is corresponded to the brightness signals A1_$L_H$, A2_$L_H$, A3_$L_H$ . . . , $An_L_H$, wherein n=1, 2, 3, . . . , N, and n is the individually controllable light source region defined in the direct-type backlight.

Wherein, the backlight brightness signals $An_L_L/An_L_H$ meet the conditions as follows:

$$An_L_L<An_L<An_L_H \quad (1\text{-}1)$$

The first pixel voltage G is looked-up. The high and low panel voltage driving signals required for compensation are $G_{TH}$ and $G_{TL}$. The high and low panel voltage driving signals are considered as the basis when computing the brightness signals $An_L_L/An_L_H$ of the region corresponded to the first frame of the image and the second frame of the image, which meet the conditions as follows:

$$G_{TH}*An_L+G_{TL}*An_L=G_{TH}*An_L_L+GTL*An_L_H \quad (1\text{-}2)$$

The second pixel voltage G' is looked-up. The high and low panel voltage driving signals required for compensation are $G'_{TH}$ and $G'_{TL}$. Similarly, they are considered as the basis when computing the brightness signals $An_L_L/An_L_H$ of the region corresponded to the first frame of the image and the second frame of the image. The brightness meets the conditions as follows:

$$G'_{TH}*An_L+G'_{TL}*An_L=G'_{TH}*An_L_L+G'_{TL}*An_L_H \quad (1\text{-}3).$$

The compensation signals $An_L_L/An_L_H$ can be obtained based on the Formulas (1-2) and (1-3), and the backlight brightness will be compensated when the next frame of the images is inputted.

Further, the step of "determining if the backlight brightness needs to be compensated or not based on the first driving signal and the second driving signal" comprises:

obtaining a difference between the first driving signal and the second driving signal corresponded to the first pixel voltage; if the value of the difference is in a predetermined range, then the backlight brightness will not be compensated; if the value of the difference is beyond the predetermined range, then the backlight brightness will be compensated.

The present embodiment applies determination based on the formula $$G_{TH}-G_{TL}<X \quad (1\text{-}4),$$

wherein X is the threshold condition of compensating the backlight brightness. When the difference of the signal voltages is not larger than X, the backlight brightness will not be compensated.

Figure 4:
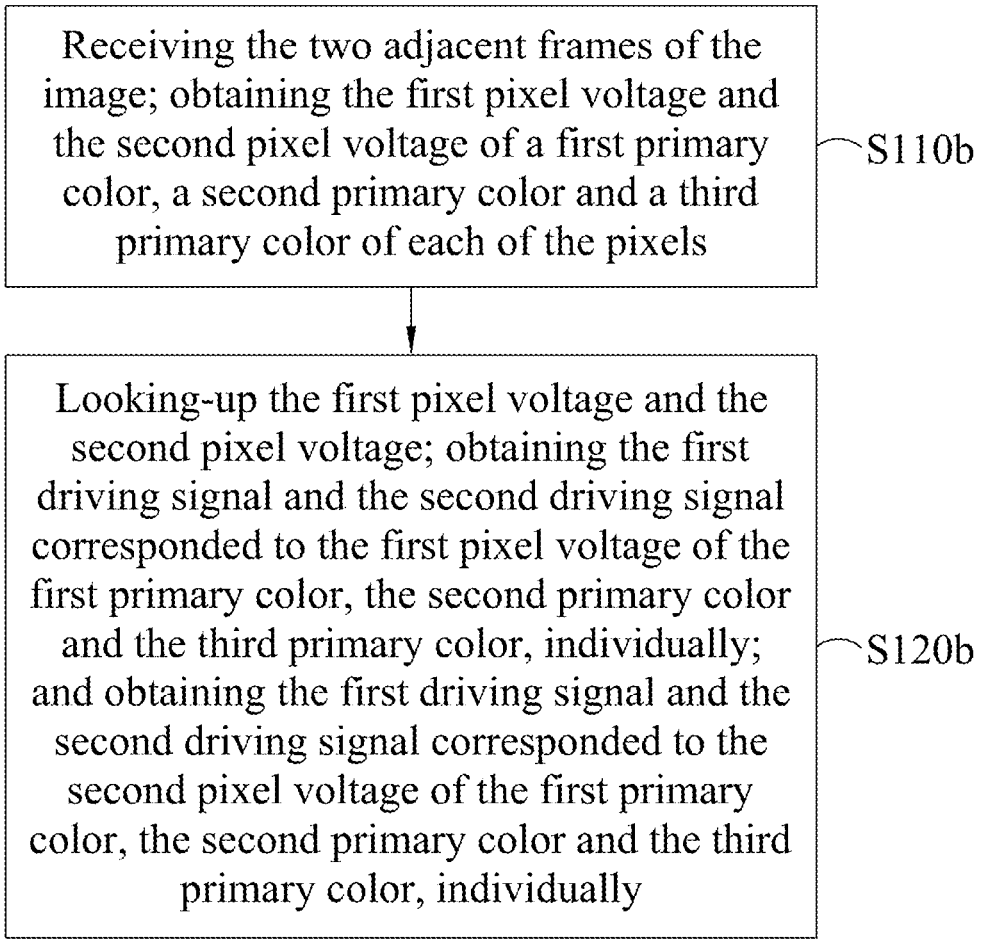
FIG. 4 is a particular flowing chart of another embodiment of the step S100 in FIG. 2.

In another embodiment, referring to FIG. 4, when a backlight source of three primary colors is utilized in the backlight module, the step of "to receive an inputted image; to obtain the panel driving signals corresponded to the backlight regions" comprises:

S110*b*, receive the two adjacent frames of the image; obtain the first pixel voltage and the second pixel voltage of a first primary color, a second primary color and a third primary color of each of the pixels;

S120*b*, look-up the first pixel voltage and the second pixel voltage; obtain the first driving signal and the second driving signal corresponded to the first pixel voltage of the first primary color, the second primary color and the third primary color, individually; and obtain the first driving signal and the second driving signal corresponded to the second pixel voltage of the first primary color, the second primary color and the third primary color, individually.

In particular, the step of "computing a brightness compensation signal required in a backlight module of a backlight region based on the first driving signal, the second driving signal and a predetermined standard brightness signal" comprises:

substituting related parameters into following formulas and computing the required brightness compensation signals:

$$An_L_R*R_{TH}+An_L_R*R_{TL}=An_L_{RL}*R_{TH}+An_L_{RH}*R_{TL};$$

$$An_L_G*G_{TH}+An_L_G*G_{TL}=An_L_{GL}*G_{TH}+An_L_{GH}*G_{TL};$$

$$An_L_B*B_{TH}+An_L_B*B_{TL}=An_L_{BL}*B_{TH}+An_L_{BH}*B_{TL};$$

$$An_L_R*R'_{TH}+An_L_R*R'_{TL}=An_L_{RL}*R'_{TH}+An_L_{RH}*R'_{TL};$$

$$An_L_G*G'_{TH}+An_L_G*G'_{TL}=An_L_{GL}*G'_{TH}+An_L_{GH}*G'_{TL};$$

$$An_L_B*B'_{TH}+An_L_B*B'_{TL}=An_L_{BL}*B'_{TH}+An_L_{BH}*B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded of the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

It has to be explained that the two adjacent frames of the image corresponding to the orders of obtained timing are utilized in the present embodiment. The first frame of the image is corresponded to the first driving signals $R_{TH}/G_{TH}/B_{TH}$, and the second frame of the image is corresponded to the second driving signals $R_{TL}/G_{TL}/B_{TL}$. A direct-type partition design is utilized in the backlight, in which each of regions is represented by A1, A2, A3 . . . , An individually. The light source of each of the regions is a combination of RGB three color light source. Region A1 is a combination of three color light sources A1R, A1G, and A1B. Region A2 is a combination of three color light sources A2R, A2G and A2B. Region An is a combination of three color light sources AnR, AnG and AnB. The region An of the first frame of the image is corresponded to the backlight brightness signals $An_L_{RL}$, $An_L_{GL}$, $An_L_{BL}$. The region An of the second frame of the image is corresponded to the backlight brightness signals $An_L_{RH}$, $An_L_{GH}$, $An_L_{BH}$. The first/second frame of the image of the region n corresponded to the backlight brightness signals $An_L_{RL}/An_L_{RH}$, $An_L_{GL}/An_L_{GH}$, $An_L_{BL}/An_L_{BH}$ are determined based on the conditions as follows:

$$An_L_{RL}<An_L_R<An_L_{RH} \quad (2\text{-}1);$$

$$An_L_{GL}<An_L_G<An_L_{GH} \quad (3\text{-}1);$$

$$An_L_{BL}<An_L_B<An_L_{BH} \quad (4\text{-}1);$$

wherein $An_L_R$, $An_L_G$, $An_L_B$ are the predetermined first standard brightness signal, the second standard brightness signal and the third standard brightness signal, respectively. The first driving signals $R_{TH}$, $G_{TH}$, $B_{TH}$, and the second driving signals $R_{TL}$, $G_{TL}$, $B_{TL}$ are obtained by looking-up the first pixel voltages R, G, B in the region n, and meet the conditions as follows:

$$R_{TH}*An_L_R+R_{TL}*An_L_R=R_{TH}*An_L_{RL}+R_{TL}*An_L_{RH} \quad (2\text{-}2)$$

$$G_{TH}*An_L_G+G_{TL}*An_L_G=G_{TH}*An_L_{GL}+G_{TL}*An_L_{GH} \quad (3\text{-}2)$$

$$B_{TH}*An_L_B+BTL*An_L_B=B_{TH}*An_L_{BL}+B_{TL}*An_L_{BH} \quad (4\text{-}2)$$

Similarly, the first driving signals $R'_{TH}$, $G'_{TH}$, $B'_{TH}$ and the second driving signals $R'_{TL}$, $G'_{TL}$, $B'_{TL}$ are obtained by looking-up the second pixel voltages R', G', B', and meet the conditions as follows:

$$R'_{TH}*An_L_R+R'_{TL}*An_L_R=R'_{TH}*An_L_{RL}+R'_{TL}*An_L_{RH} \quad (2\text{-}3)$$

$$G'_{TH}*An_L_G+G'_{TL}*An_L_G=G'_{TH}*An_L_{GL}+G'TL*An_L_{GH} \quad (3\text{-}3)$$

$$B'_{TH}*An_L_B+B'_{TL}*An_L_B=B'_{TH}*An_L_{BL}+B'_{TL}*An_L_{BH} \quad (4\text{-}3)$$

By substituting related parameters, the brightness compensation signals $An_L_{RL}$, $An_L_{RH}$, $An_L_{GL}$, $An_L_{GH}$, $An_L_{BL}$ and $An_L_{BH}$ required by the backlight source of the three primary colors can be obtained based on the above Formulas 2-2, 2-3, 3-2, 3-3, 4-2, 4-3.

Further, the brightness compensation is required or not is determined based on the first driving signal and the second driving signal corresponded to the first pixel voltage.

The compensation of view chromatic aberration is required or not is determined based on the determination formulas as follows:

$$R_{TH}-R_{TL}<X \quad (2\text{-}4)$$

$$G_{TH}-G_{TL}<Y \quad (3\text{-}4)$$

$$B_{TH}-B_{TL}<Z \quad (4\text{-}4)$$

Wherein, X, Y, Z are the threshold conditions which actives the compensation by the backlight brightness. When the difference between the high and low panel driving voltage signal corresponded to first pixel voltage R, G, B is larger than any one of X, Y and Z, the backlight brightness compensation is activated.

To solve the defect of view chromatic aberration of the TN, OCB and VA type TFT display panels, the technical solutions of the present application utilizes a direct or edge type backlight, white light or RGB (red, green, blue) light source of three colors, taken in conjunction with the panel high second driving signal, so as to compensate and to adjust the backlight brightness, and to reduce the blinking caused by the switching between the panel high and low voltage driving signals. Simultaneously, this may also maintain the advantage of the compensation of view chromatic aberration by the high and low liquid crystal voltage. Secondly, the pixel are not designed to be main and sub pixels, which greatly improves the transmittance of the TFT display panel and reduces the design of the backlight cost. In terms of the development of high resolution TFT display panels, the pixels without the main and sub pixel designs effects affects the transmittance and improvement of resolution more apparently.

Figure 5:
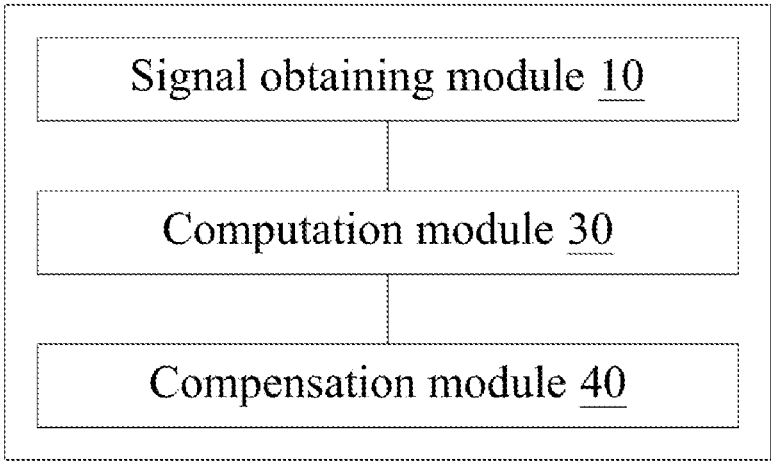
FIG. 5 is a functional block diagram of an embodiment of the view chromatic aberration compensation apparatus of a display device of the present application.

Referring to FIG. 5, the present application provides a view chromatic aberration compensation apparatus of a display device, which may be such as a television or computer, comprising:

a signal obtaining module 10 for receiving an inputted image; obtaining a first pixel voltage and a second pixel voltage of each of pixels in two adjacent frames of the image; and looking-up the first pixel voltage and the second pixel voltage and obtaining a corresponded first driving signal and a corresponded second driving signal, individually;

a computation module 30 for computing a brightness compensation signal required in two frames of a backlight module of a backlight region corresponded to voltages of different levels, based on the first driving signal, the second driving signal and a predetermined standard brightness signal; and a backlight compensation module 40 for compensating view chromatic aberration of a post frame of the image based on the brightness compensation signal.

Figure 6:
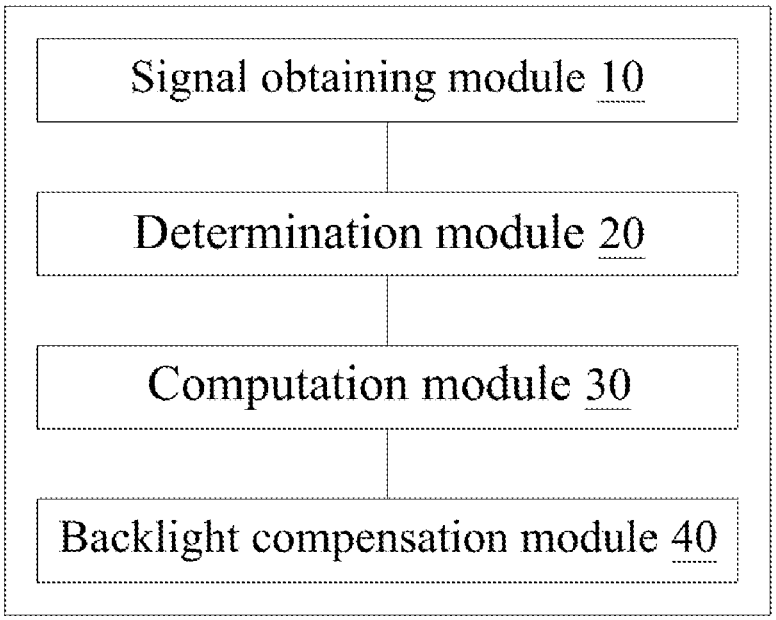
FIG. 6 is a functional block diagram of a particular embodiment of the view chromatic aberration compensation apparatus of a display device of the present application.

Referring to FIG. 6, further, the view chromatic aberration compensation apparatus of the display device comprises:

a determination module 20 for determining if the backlight brightness needs to be compensated or not based on the first driving signal and the second driving signal.

In particular, when a backlight source of white color is utilized in the backlight module, the signal obtaining module receives the two adjacent frames of the image; obtains the first pixel voltage and the second pixel voltage; looks-up the first pixel voltage and the second pixel voltage; obtains the first driving signal and the second driving signal corresponded to the first pixel voltage; and obtains the first driving signal and the second driving signal corresponded to the second pixel voltage.

Furthermore, the first primary color is green primary color.

In particular, the computation modules 30 substitutes related parameters into following formulas and computes the required brightness compensation signals:

$$An_L*G_{TH}+An_L*G_{TL}=An_L_L*G_{TH}+An_L_H*G_{TL};$$

$$An_L*G'_{TH}+An_L*G'_{TL}=An_L_L*G'_{TH}+An_L_H*G'_{TL};$$

wherein An_L is the standard brightness signal; $G_{TH}$, $G_{TL}$ are the first driving signal and the second driving signal corresponded to the first pixel voltage respectively; $G'_{TH}$, $G'_{TL}$ are the first driving signal and the second driving signal corresponded to the second pixel voltage; and $An_L_L$ and $An_L_H$ are the brightness compensation signals required for computation.

In particular, the determination module 20 obtains a difference between the first driving signal and the second driving signal corresponded to the first pixel voltage; if the value of the difference is in a predetermined range, then the backlight brightness will not be compensated; if the value of the difference is beyond the predetermined range, then the backlight brightness will be compensated.

In particular, when a backlight source of three primary colors is utilized in the backlight module, the signal obtaining module 10 receives the two adjacent frames of the image; obtains the first pixel voltage and the second pixel voltage of a first primary color, a second primary color and a third primary color of each of the pixels; and looks-up the first pixel voltage and the second pixel voltage; obtains the first driving signal and the second driving signal corresponded to the first pixel voltage of the first primary color, the second primary color and the third primary color, individually; and obtains the first driving signal and the second driving signal corresponded to the second pixel voltage of the first primary color, the second primary color and the third primary color, individually.

In particular, the computation module 30 substitutes related parameters into following formulas and computes the required brightness compensation signals:

$$An_L_R*R_{TH}+An_L_R*R_{TL}=An_L_{RL}*R_{TH}+An_L_{RH}*R_{TL};$$

$$An_L_G*G_{TH}+An_L_G*G_{TL}=An_L_{GL}*G_{TH}+An_L_{GH}*G_{TL};$$

$$An_L_B*B_{TH}+An_L_B*B_{TL}=An_L_{BL}*B_{TH}+An_L_{BH}*B_{TL};$$

$$An_L_R*R'_{TH}+An_L_R*R'_{TL}=An_L_{RL}*R'_{TH}+An_L_{RH}*R'_{TL};$$

$$An_L_G*G'_{TH}+An_L_G*G'_{TL}=An_L_{GL}*G'_{TH}+An_L_{GH}*G'_{TL};$$

$$An_L_B*B'_{TH}+An_L_B*B'_{TL}=An_L_{BL}*B'_{TH}+An_L_{BH}*B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded to the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

A person skilled in the related art should understand that the present application further provides a view chromatic aberration compensation apparatus of a display device, which comprises a processor and a nonvolatile memory. The nonvolatile memory stores executable instructions, and the processor executes the executable instructions in order to achieve the method described in each of aforementioned embodiments. A person skilled in the related art should further understand that the module/unit 10, 20, 30 and 40 shown in FIG. 6 of the present application may be a software module or a software unit. Furthermore, various software modules or software units may be stored in the nonvolatile memory and executed by the processor inherently.

Figure 7:
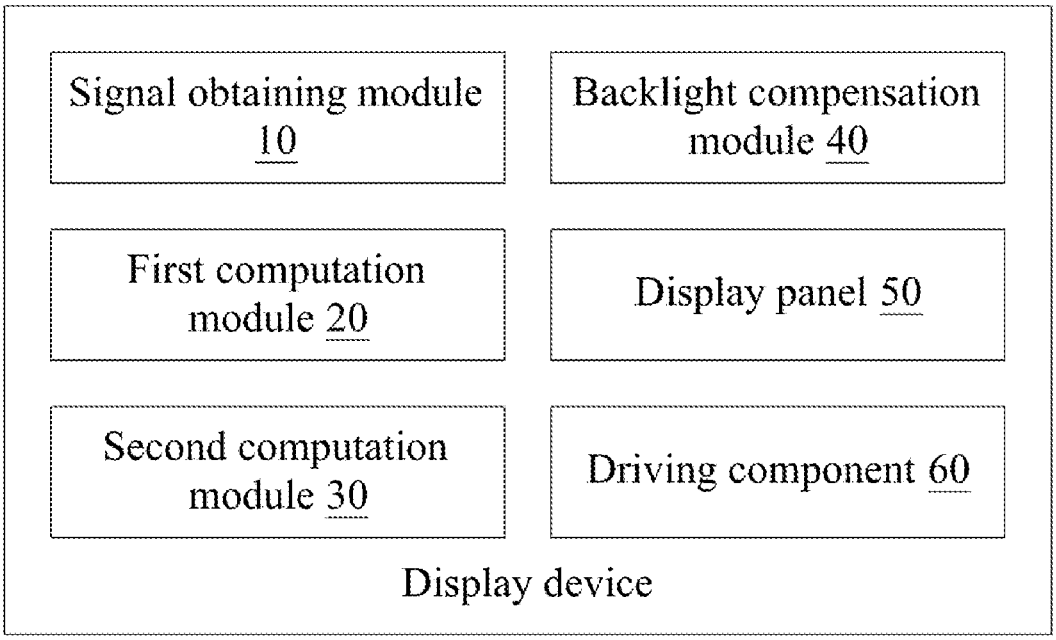
FIG. 7 is a functional block diagram of an embodiment of the display device of the present application.

Referring to FIG. 7, the present application further provide a display device, comprising a display panel 50, a driving component 60 and the view chromatic aberration compensation apparatus mentioned above. The substantial structure of the view chromatic aberration compensation apparatus of the display device are referred to the embodiments mentioned above. Since the present display device utilizes all of the technical solutions of the embodiments mentioned above, thus it possesses at least one of the benefits of the technical solutions of the embodiments mentioned above. Hence, they are no longer to be repeated one by one.

While the embodiments described above are merely preferable embodiments the present invention, hence the present invention is not limited thereto. In the context of the inventive concept of the present application, various equivalent changes of the structures, or directly/indirectly uses in other related technical fields are covered in the scope of the present invention.

What is claimed is:

1. A method of compensating view chromatic aberration of a display device, comprising steps as follows:

controlling the display device to receive an inputted image; obtaining a first pixel voltage and a second pixel voltage of each of pixels in two adjacent frames of the image; looking-up the first pixel voltage and the second pixel voltage and obtaining a corresponded first driving signal and a corresponded second driving signal, individually;

computing a brightness compensation signal required in a backlight module of a backlight region based on the first driving signal, the second driving signal and a predetermined standard brightness signal; and compensating the backlight module of the backlight region for a post frame of the image based on the brightness compensation signal thereby achieving view chromatic aberration compensation of the post frame of the image, wherein the step of computing the brightness compensation signal comprises:

substituting related parameters into following formulas and computing the required brightness compensation signals:

$$An_L \times G_{TH} + An_L \times G_{TL} = An_L_L \times G_{TH} + An_L_H \times G_{TL};$$

$$An_L \times G'_{TH} + An_L \times G'_{TL} = An_L_L \times G'_{TH} + An_L_H \times G'_{TL};$$

wherein An_L is the standard brightness $G_{TH}$, $G_{TL}$ are the first driving signal and the second driving signal corresponded to the first pixel voltage; $G'_{TH}$, $G'_{TL}$ are the first driving signal and the second driving signal corresponded to the second pixel voltage; and $An_L_L$ and $An_L_H$ are the brightness compensation signals required for computation.

2. The method of compensating view chromatic aberration of the display device as claimed in claim 1, wherein after the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually", the method further comprises a step of:

determining if the backlight brightness needs to be compensated or not based on the first driving signal and the second driving signal.

3. The method of compensating view chromatic aberration of the display device as claimed in claim 2, wherein when a backlight source of white color is configured in the backlight module, the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually" comprises:

receiving the two adjacent frames of the image; obtaining the first pixel voltage and the second pixel voltage of a first primary color of each of the pixels; and looking-up the first pixel voltage and the second pixel voltage; obtaining the first driving signal and the second driving signal corresponded to the first pixel voltage; and obtaining the first driving signal and the second driving signal corresponded to the second pixel voltage.

4. The method of compensating view chromatic aberration of the display device as claimed in claim 3, wherein the first primary color is green primary color.

5. The method of compensating view chromatic aberration of the display device as claimed in claim 3, wherein the step of "determining if the backlight brightness needs to be compensated or not based on the first driving signal and the second driving signal" comprises:

obtaining a difference between the first driving signal and the second driving signal corresponded to the first pixel voltage; wherein if the value of the difference is in a predetermined range, the backlight brightness will not be compensated; wherein if the value of the difference is beyond the predetermined range, the backlight brightness will be compensated.

6. The method of compensating view chromatic aberration of the display device as claimed in claim 2, wherein when a backlight source of three primary colors is configured in the backlight module, the step of "to receive an inputted image; to obtain a first pixel voltage and a second pixel voltage of each of pixels in two adjacent frames of the image; to look-up the first pixel voltage and the second pixel voltage and to obtain a corresponded first driving signal and a corresponded second driving signal, individually" comprises:

receiving the two adjacent frames of the image; obtaining the first pixel voltage and the second pixel voltage of a first primary color, a second primary color and a third primary color of each of the pixels; and looking-up the first pixel voltage and the second pixel voltage; obtaining the first driving signal and the second driving signal corresponded to the first pixel voltage of the first primary color, the second primary color and the third primary color, individually; and obtaining the first driving signal and the second driving signal corresponded to the second pixel voltage of the first primary color, the second primary color and the third primary color, individually.

7. The method of compensating view chromatic aberration of the display device as claimed in claim 6, wherein the step of "computing a brightness compensation signal required in a backlight module of a backlight region based on the first driving signal, the second driving signal and a predetermined standard brightness signal" comprises:

substituting related parameters into following formulas and computing the required brightness compensation signals:

$$An_L_R \times R_{TH} + An_L_R \times R_{TL} = An_L_{RL} \times R_{TH} + An_L_{RH} \times R_{TL};$$

$$An_L_G \times G_{TH} + An_L_G \times G_{TL} = An_L_{GL} \times G_{TH} + An_L_{GH} \times G_{TL};$$

$$An_L_B \times B_{TH} + An_L_B \times B_{TL} = An_L_{BL} \times B_{TH} + An_L_{BH} \times B_{TL};$$

$$An_L_R \times R'_{TH} + An_L_R \times R'_{TL} = An_L_{RL} \times R'_{TH} + An_L_{RH} \times R'_{TL};$$

$$An_L_G \times G'_{TH} + An_L_G \times G'_{TL} = An_L_{GL} \times G'_{TH} + An_L_{GH} \times G'_{TL};$$

$$An_L_B \times B'_{TH} + An_L_B \times B'_{TL} = An_L_{BL} \times B'_{TH} + An_L_{BH} \times B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded to the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

8. A view chromatic aberration compensation apparatus of a display device, comprising:

a signal obtaining module for receiving an inputted image; obtaining a first pixel voltage and a second pixel voltage of each of pixels in two adjacent frames of the image; and looking-up the first pixel voltage and the second pixel voltage and obtaining a corresponded first driving signal and a corresponded second driving signal, individually;

a computation module for computing a brightness compensation signal required in two frames of a backlight module of a backlight region corresponded to voltages of different levels, based on the first driving signal, the second driving signal and a predetermined standard brightness signal; and a backlight compensation module for compensating the backlight module of the backlight region for a post frame of the image based on the brightness compensation signal thereby achieving view chromatic aberration compensation of the post frame of the image, wherein the computation module substitutes related parameters into following formulas and computes the required brightness compensation signals:

$$An_L \times G_{TH} + An_L \times G_{TL} = An_L_L \times G_{TH} + An_L_H \times G_{TL};$$

$$An_L \times G'_{TH} + An_L \times G'_{TL} = An_L_L \times G'_{TH} + An_L_H \times G'_{TL};$$

wherein An_L is the standard brightness $G_{TH}$, $G_{TL}$ are the first driving signal and the second driving signal corresponded to the first pixel voltage; $G'_{TH}$, $G'_{TL}$ are the first driving signal and the second driving signal corresponded to the second pixel voltage; and $An_L_L$ and $An_L_H$ are the brightness compensation signals required for compensation.

9. The view chromatic aberration compensation apparatus of the display device as claimed in claim 8, further comprising:

a determination module for determining if the backlight brightness needs to be compensated or not based on the first driving signal and the second driving signal.

10. The view chromatic aberration compensation apparatus of the display device as claimed in claim 9, wherein when a backlight source of white color is configured in the backlight module, the signal obtaining module receives the two adjacent frames of the image; obtains the first pixel voltage and the second pixel voltage; looks-up the first pixel voltage and the second pixel voltage; obtains the first driving signal and the second driving signal corresponded to the first pixel voltage; and obtains the first driving signal and the second driving signal corresponded to the second pixel voltage.

11. The view chromatic aberration compensation apparatus of the display device as claimed in claim 10, wherein the first primary color is green primary color.

12. The view chromatic aberration compensation apparatus of the display device as claimed in claim 10, wherein the determination module obtains a difference between the first driving signal and the second driving signal corresponded to the first pixel voltage; wherein if the value of the difference is in a predetermined range, the backlight brightness will not be compensated; wherein if the value of the difference is beyond the predetermined range, the backlight brightness will be compensated.

13. The view chromatic aberration compensation apparatus of the display device as claimed in claim 9, wherein when a backlight source of three primary colors is configured in the backlight module, the signal obtaining module receives the two adjacent frames of the image; obtains the first pixel voltage and the second pixel voltage of a first primary color, a second primary color and a third primary color of each of the pixels; and looks-up the first pixel voltage and the second pixel voltage; obtains the first driving signal and the second driving signal corresponded to the first pixel voltage of the first primary color, the second primary color and the third primary color, individually; and obtains the first driving signal and the second driving signal corresponded to the second pixel voltage of the first primary color, the second primary color and the third primary color, individually.

14. The view chromatic aberration compensation apparatus of the display device as claimed in claim 13, wherein the computation module substitutes related parameters into following formulas and computes the required brightness compensation signals:

$$An_L_R \times R_{TH} + An_L_R \times R_{TL} = An_L_{RL} \times R_{TH} + An_L_{RH} \times R_{TL};$$

$$An_L_G \times G_{TH} + An_L_G \times G_{TL} = An_L_{GL} \times G_{TH} + An_L_{GH} \times G_{TL};$$

$$An_L_B \times B_{TH} + An_L_B \times B_{TL} = An_L_{BL} \times B_{TH} + An_L_{BH} \times B_{TL};$$

$$An_L_R \times R'_{TH} + An_L_R \times R'_{TL} = An_L_{RL} \times R'_{TH} + An_L_{RH} \times R'_{TL};$$

$$An_L_G \times G'_{TH} + An_L_G \times G'_{TL} = An_L_{GL} \times G'_{TH} + An_L_{GH} \times G'_{TL};$$

$$An_L_B \times B'_{TH} + An_L_B \times B'_{TL} = An_L_{BL} \times B'_{TH} + An_L_{BH} \times B'_{TL};$$

wherein $An_L_R$, $An_L_G$, $An_L_B$ are a first standard brightness signal, a second standard brightness signal and a third standard brightness signal, respectively;

$R_{TH}$, $R_{TL}$ are the first driving signal and the second driving signal corresponded to the first pixel voltage of the first primary color; $R'_{TH}$, $R'_{TL}$ are the first driving signal and the second driving signal corresponded to the second pixel voltage of the first primary color;

$G_{TH}$, $G_{TL}$ are the first driving signal and the second driving signal corresponded to the first pixel voltage of the second primary color; $G'_{TH}$, $G'_{TL}$ are the first driving signal and the second driving signal corresponded to the second pixel voltage of the second primary color;

$B_{TH}$, $B_{TL}$ are the first driving signal and the second driving signal corresponded to the first pixel voltage of the third primary color; $B'_{TH}$, $B'_{TL}$ are the first driving signal and the second driving signal corresponded to the second pixel voltage of the third primary color; and $An_L_{RL}$, $An_L_{RH}$, $An_L_{GL}$, $An_L_{GH}$, $An_L_{BL}$ and $An_L_{BH}$ are the brightness compensation signals required for computation.

15. A display device, comprising:

a display panel;

a driving component; and a view chromatic aberration compensation apparatus, comprising:

a signal obtaining module for receiving an inputted image; obtaining a first pixel voltage and a second pixel voltage of each of pixels in two adjacent frames of the image; and looking-up the first pixel voltage and the second pixel voltage and obtaining a corresponded first driving signal and a corresponded second driving signal, individually;

a computation module for computing a brightness compensation signal required in two frames of a backlight module of a backlight region corresponded to voltages of different levels, based on the first driving signal, the second driving signal and a predetermined standard brightness signal; and a backlight compensation module for compensating the backlight module of the backlight region for of a post frame of the image based on the brightness compensation signal thereby achieving view chromatic aberration compensation of the post frame of the image, wherein the computation module substitutes related parameters into following formulas and computes the required brightness compensation signals:

$$An_L \times G_{TH} + An_L \times G_{TL} = An_L_L \times G_{TH} + An_L_H \times G_{TL};$$

$$An_L \times G'_{TH} + An_L \times G'_{TL} = An_L_L \times G'_{TH} + An_L_H \times G'_{TL};$$

wherein An_L is the standard brightness $G_{TH}$, $G_{TL}$ are the first driving signal and the second driving signal corresponded to the first pixel voltage; $G'_{TH}$, $G'_{TL}$ are the first driving signal and the second driving signal corresponded to the second pixel voltage; and $An_L_L$ and $An_L_H$ are the brightness compensation signals required for computation.

* * * * *